US007886681B2

(12) United States Patent
Weinstein et al.

(10) Patent No.: US 7,886,681 B2
(45) Date of Patent: Feb. 15, 2011

(54) ANCHOR RETRIEVAL DEVICE, SYSTEM AND METHOD

(75) Inventors: Peter Michael Weinstein, 1472 Butterfiled Ct., Marco Island, FL (US) 34145; David C. Everson, Marco Island, FL (US)

(73) Assignee: Peter Michael Weinstein, Marco Island, FL (US)

( * ) Notice: Subject to any disclaimer, the term of this patent is extended or adjusted under 35 U.S.C. 154(b) by 0 days.

(21) Appl. No.: 12/459,085

(22) Filed: Jun. 26, 2009

(65) Prior Publication Data

US 2010/0064957 A1 Mar. 18, 2010

Related U.S. Application Data

(60) Provisional application No. 61/084,594, filed on Jul. 29, 2008.

(51) Int. Cl.
*B63B 21/46* (2006.01)

(52) U.S. Cl. ..... 114/299

(58) Field of Classification Search ..... 114/297, 114/299

See application file for complete search history.

(56) References Cited

U.S. PATENT DOCUMENTS

| | | | | | |
|---|---|---|---|---|---|
| 1,768,484 | A | | 6/1930 | Lotts | |
| 2,568,006 | A | * | 9/1951 | Illsche | 114/299 |
| 2,816,522 | A | | 11/1955 | Root | |
| 2,764,116 | A | * | 9/1956 | Brewer | 114/299 |
| 3,150,629 | A | * | 9/1964 | Fields | 114/299 |
| 3,436,795 | A | | 4/1969 | Hill | |
| 3,625,175 | A | | 12/1971 | Mangel | |
| 3,995,577 | A | | 12/1976 | Gentry | |
| 4,019,455 | A | | 4/1977 | Hungerford | |
| 4,114,554 | A | | 9/1978 | Miller | |
| 4,154,186 | A | | 5/1979 | van den Haak | |
| 4,389,907 | A | | 6/1983 | Epstein | |
| RE31,654 | E | | 8/1984 | Fasco | |
| 4,471,511 | A | | 9/1984 | Phipps | |
| 4,644,894 | A | | 2/1987 | Woodgate | |
| 4,721,054 | A | * | 1/1988 | Kobayashi | 114/299 |
| 4,836,126 | A | * | 6/1989 | Kobayashi | 114/297 |
| 4,951,593 | A | | 8/1990 | Brown | |
| 5,074,235 | A | | 12/1991 | Kobayashi | |
| 5,095,842 | A | | 3/1992 | Soules | |
| 5,123,374 | A | | 6/1992 | McMillan | |
| 5,152,567 | A | | 10/1992 | Raber | |
| 5,207,775 | A | * | 5/1993 | Piton et al. | 114/299 |
| 5,474,015 | A | | 12/1995 | Bruce | |
| 5,784,981 | A | | 7/1998 | Graham, Sr. | |
| 6,009,826 | A | * | 1/2000 | Nole | 114/299 |
| 6,027,154 | A | | 2/2000 | Costa | |
| 6,038,996 | A | | 3/2000 | Giles | |
| 6,209,475 | B1 | * | 4/2001 | Powell | 114/299 |
| 6,951,183 | B1 | | 10/2005 | Burback | |

* cited by examiner

*Primary Examiner*—Daniel V Venne
(74) *Attorney, Agent, or Firm*—Frank J. Bonini, Jr.; John F. A. Earley, III; Harding, Earley, Follmer & Frailey, P.C.

(57) ABSTRACT

A method, system and device for facilitating the retrieval of a marine anchor from an underwater obstruction, the device being configured to actuate when subjected to a force load of a predetermined peak force threshold to effect a change in the point of retrieval that an anchor rode makes with the anchor. The obstructed anchor may be retrieved from another direction, such as a direction opposite from which the anchor was set.

15 Claims, 5 Drawing Sheets

ANCHOR RETRIEVAL DEVICE, SYSTEM AND METHOD

CROSS-REFERENCE TO RELATED APPLICATIONS

This application claims priority to U.S. Provisional Application Ser. No. U.S. 61/084,594, filed on Jul. 29, 2008, the complete disclosure of which is herein incorporated by reference.

BACKGROUND OF THE INVENTION

1. Field of the Invention

The present invention relates to devices, methods and systems for retrieving and releasing marine anchors, and, more particularly, devices, methods and systems that may be installed on existing marine anchors to facilitate retrieval of an anchor lodged in an underwater obstruction and cannot be retrieved via conventional methods.

2. Brief Description of the Related Art

Marine anchors are widely used to secure marine vessels at a location on a body of water. Generally anchors are constructed from metal and are of suitable weight, size and shape to facilitate retention of the anchor on the bottom of a water body. Marine vessels and other watercrafts often carry one or more anchors which are used to secure the vessel in a location so that the vessel may hold its position as currents, tides and wind may act to move or pull the vessel in one direction or another. Anchors can have different configurations and different weights and are selected for use based on the size of the vessel or watercraft as well as the nature of the bottom to which the anchor will be set. One typical configuration of an anchor includes a shank with a crown on one end. A fluke and a point or other configuration typically is provided at the crown end for securing the anchor to an underwater bottom surface. The anchor, opposite the crown end, in a typical configuration, has an eye or ring to which a cable, line or chain, generally referred to as the anchor rode, may be attached for lifting the anchor. Some anchors also have a stock which may add further weight to the anchor or may be used to secure the anchor when it is stowed aboard a vessel.

The topography of underwater bottoms, such as that of lakes, rivers, seas and oceans, may vary. Bottom types that may be encountered include sandy bottoms, muddy bottoms, rocky bottoms, combinations of these, as well as natural and man-made structures that may be present on the water bottom. Generally, most typical anchors have one or more flanges, such as metal flukes which are designed to bury themselves in sandy or muddy (e.g., soft) bottoms. When rocky bottoms are encountered, the anchor fluke will often hook itself to the rock.

The anchor and anchor rode need to remain secure and withstand forces when the boat is exposed to wind, current, wakes from passing vessels, and other forces that may act on an anchored vessel. The anchor rode attached to the anchor, in some cases, may slacken when a boat is moved in a direction toward the anchor, and conversely, forces also may operate to create tension on the anchor line when a wave pulls the vessel in a direction away from the anchor location. Because the anchor must remain secure at a location on the water bottom in order to withstand these types of forces, generally, it is desirable to set the anchor so that a portion of the anchor, such as, for example, an anchor fluke, buries itself in the bottom. However, rocks or other structure (such as sunken vessels, debris, concrete pieces) that serve as potential obstructions to the anchor may be unnoticed when the anchor is initially deployed. So in cases even where a watercraft operator uses care, and does not have a reason to believe that the water craft was being anchored to an underwater structure, it still is not uncommon for a marine anchor to become lodged in an underwater obstruction. In order to retrieve a marine anchor from an underwater bottom, generally the anchor rode or line is retracted and must overcome an initial force to dislodge the anchor from its set condition. When the anchor is set a corresponding compass heading that the boat is pointing towards when in an anchored position may be determined. For example, if an anchor set is South 180 degrees, when one is attempting to release the set anchor, one would generally follow that heading to back the lodged anchor out. Once the initial set force is overcome, the anchor is pulled up from the water bottom by hoisting the anchor line, and then withdrawn from the water and stowed aboard the vessel. The retrieval of a set anchor is routinely accomplished with the assistance of a device or mechanism, such as a windlass, a winding device which generally may be operated to retrieve the anchor line and anchor with its motorized or manual mechanism (though other manual methods also may be used, such as pulling the line itself, with the use of rollers, manual pulleys or reels). Similarly, mechanical or electromechanical devices, such as a windlass, also may be used to lower the anchor when anchoring the vessel. In other instances, depending on the size of the vessel and the size of the anchor, it is not uncommon to retrieve an anchor by manually lifting the anchor line and retrieving the anchor and manually stowing it aboard the vessel.

However, in many cases, the anchor may become lodged in an underwater obstruction, whether a natural obstruction (e.g., rocks or coral) or an obstruction such as debris, a wreck or other objects. Many anchors, in spite of the maneuvering efforts that may be made by vessel is captain and operators, simply cannot be retrieved once lodged in an obstruction. Therefore, in many instances, there is no choice but to sever the anchor line or cable in order to release the vessel from the anchor. In these instances the anchor remains lodged in the underwater obstruction, which generally is at the bottom of the water environment.

When an anchor becomes stuck and cannot be retrieved, the cost and inconvenience to the vessel owner may be extensive. Often divers retrieve abandoned anchors from underwater locations and resell them. If a vessel operator is an avid boater or operates his craft frequently, there may be more stuck encounters and periodic anchor losses. Though care may be used when anchoring so that an obstruction is attempted to be avoided, many elements, such as strong winds, currents, tides, and sometimes even boat traffic, may make it difficult or impossible at all times to anchor in an obstruction free zone. In addition, where boaters operate their crafts in waters that have rocky bottoms, it may be difficult to avoid potential obstructions.

One example of a device that has attempted to address the problem of anchor retrieval, involves providing a specially configured anchor. However, this is generally expensive and requires a particular replacement of an existing anchor. Another example of a device involves a shank constructed from sections that may hinge apart from one another.

A need exists for a device, system and method which may be used in conjunction with a variety of existing marine anchors to facilitate the retrieval of an anchor that is lodged in some type of underwater structure. A further need is to provide an anchor retrieval device that is easy to install and operate and is economical.

SUMMARY OF THE INVENTION

A retrieval device, system and method are provided for retrieving marine anchors that have become lodged in an underwater obstruction. The retrieval device, system and method are designed to be used in conjunction with a variety of existing anchors styles.

It is not uncommon for a marine anchor to become lodged when pulled or lowered into an underwater obstruction through the normal course of anchoring a boat. Even if the proper anchoring procedures are followed, in many cases, a marine anchor may become lodged in an obstruction. The present invention is designed to facilitate the release and retrieval of a variety of commonly used marine anchors from underwater structures to which the anchor has become lodged.

According to preferred embodiments, the retrieval device may be installed on an existing anchor utilizing the existing anchor line (or anchor rode as it is generally referred to). The retrieval device, system and method allow the anchor to be pulled in different directions by applying a pulling force to a different point of the anchor through the operation of the device. For example, the device may facilitate pulling the anchor in a direction that is opposite of the direction in which the anchor was set.

According to preferred embodiments, actuation of the device redirects the point of connection at which the pulling retrieval force is applied to raise the anchor.

When the anchor is not inhibited by an obstruction, the anchor may be lowered, set and retrieved in the customary manner, even when the retrieval device is installed. A first pulling force may be applied in the convention manner to retrieve an anchor by causing the anchor set to release from the water bottom to which it was previously set. Where the conventional force, however, is unsuccessful, and the conventional method is unsuccessful to release a set anchor, a release mechanism of the retrieval device may then be triggered by applying additional force to the anchor line.

According to preferred embodiments, the release mechanism may be actuated when a peak force threshold is met and, once actuated, the direction of pull on the anchor is changed by changing the retrieval terminal location on the anchor from one point to another. This facilitates retrieval of the obstructed anchor by providing the ability to back out and retrieve the anchor, for example, by pulling the anchor from a direction opposite that of the direction of the initial pulling force (that was unsuccessful to retrieve the anchor).

Another feature of the retrieval device, system and method is a reset feature which may be used to facilitate raising a released anchor back into or over the bow or pulpit of a vessel. The reset feature enables an anchor that is retrieved from a point other than the shank eye to be righted so that the anchor shank may be the leading end of the anchor when the anchor (e.g., such as a dislodged anchor) is raised aboard the boat.

According to preferred embodiments, the release mechanism of the retrieval device may be configured to have a pre-determined peak force threshold for actuation. Retrieval devices may be constructed with various force thresholds, so that a retrieval device used for a larger vessel has a larger force threshold for release than a retrieval device used for a small vessel. The predetermined peak force threshold may vary and, for example, may take into account the weight of the vessel, the anchor weight, conditions of use, the type of vessel that the device is to be used in conjunction with, or any combination of these.

The retrieval device, system and method are designed to be utilized with most existing anchors. Most anchors include a shank eye and a crown eye, and, in most instances, the anchor rode includes a length of chain that connects the anchor with another portion of the anchor rode, such as, for example, a cable or rope. The retrieval device may be used with many commonly used anchors without the need to make modifications. Examples of anchors with which the device, system and method may be used include fluke type, claw or hook type, plough type, and the like, as well as Delta, Danforth, and Rockna anchors.

The retrieval system, method and device may be used for watercraft and most power and sailboats that have sufficient power to overcome the force threshold of the release mechanism. According to preferred embodiments, where a release mechanism includes a release pin, the sufficient power required for actuation is that to break the designated release pin.

The device may be configured to permit permanent mooring. In the event permanent mooring, is desired, such as, for example, in extreme storm and wind conditions, according to preferred embodiments, the retrieval device is adaptable and may be readily removed or bypassed, or the shearable component replaced with stronger component, for example, in such conditions, an appropriately heavy steel bolt may be substituted for the release pin.

The retrieval device may also be utilized to facilitate stowage of an anchor aboard a vessel by encouraging the anchor to seat itself in a proper position on the bow or pulpit. According to preferred embodiments, the device may be installed to connect the anchor chain to the anchor in a configuration that, when retrieved onto the vessel, provides the anchor with the ability to pivot relative to the chain so the anchor may seat into a desired stowage position.

BRIEF DESCRIPTION OF THE DRAWING FIGURES

DETAILED DESCRIPTION OF THE PREFERRED EMBODIMENTS

Figure 1:
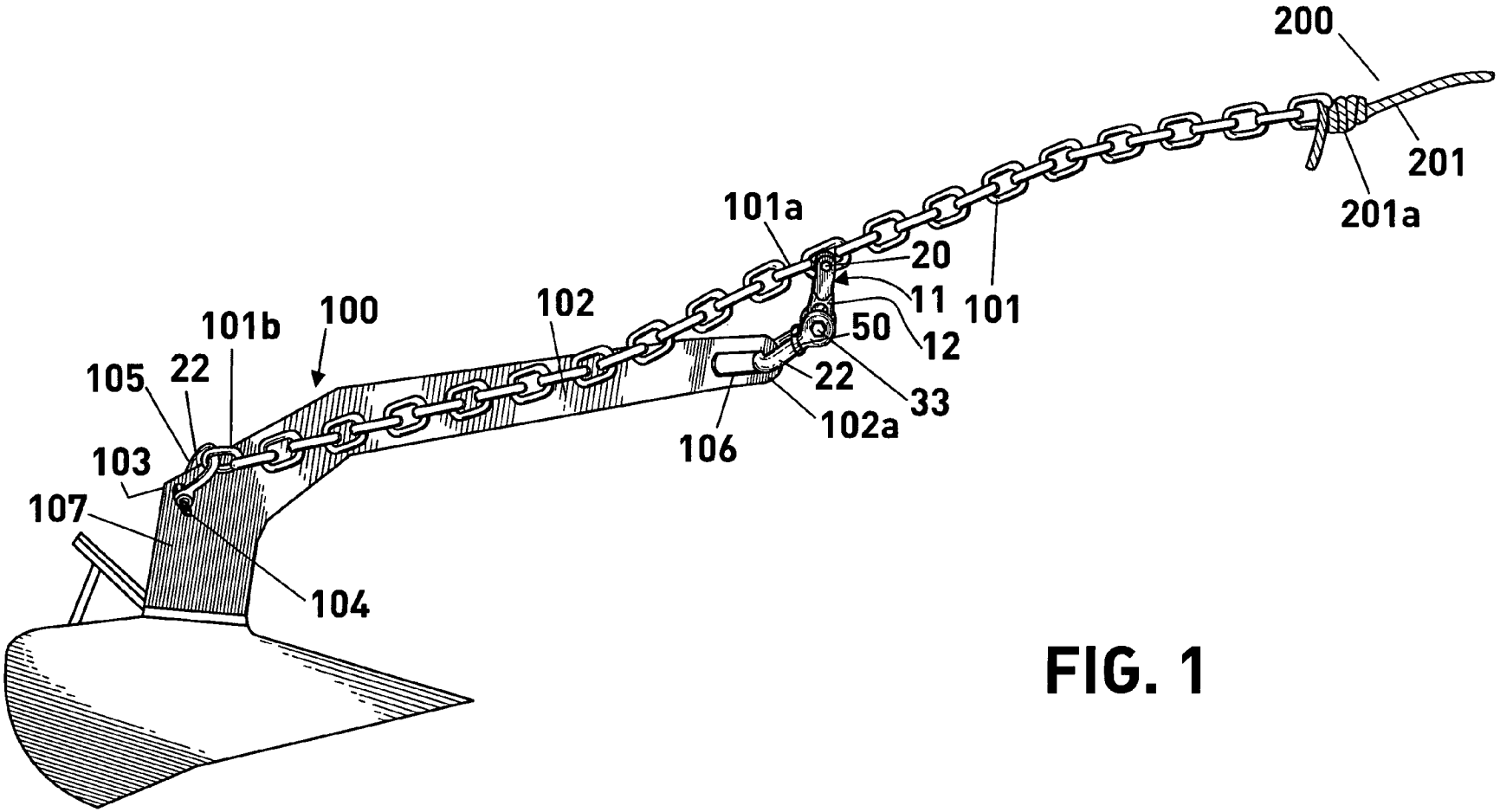
FIG. 1 is a side perspective view showing an exemplary embodiment of a retrieval device installed on an anchor in accordance with the method and system of the invention.

Referring to FIG. 1, there is illustrated a retrieval device 10 for facilitating retrieval of a marine anchor 100 from the bottom of a body of water. Though the anchor 100 is illustrated as a claw or Bruce type anchor, the retrieval device 10 may be used in conjunction with a wide variety of other types of anchors (including fluke types, claw or hook types, plough types, and the like). The retrieval device 10 is used to effect a change in the pulling direction of the anchor 100 by changing the location that the anchor rode 200 makes with the anchor 100. The retrieval device 10, as illustrated in the exemplary embodiment in FIG. 1, is configured so that it may connect to the marine anchor 100 and also connect to the anchor rode 200, where the anchor rode 200 is shown comprising an anchor chain 101 and rope section 201. Generally, typical anchor rodes may comprise an all-rope rode (for smaller vessels), an all-chain rode (for larger vessels), or a combination rope and chain rode. The combination type rodes generally include a chain section having one end that attaches to the anchor and another end that attaches to a rope section (or other cable) that leads to the boat. The end of the rope 201 opposite the chain secured end 201*a* generally is secured aboard a structure of the vessel, such as for example, a windlass or cleat.

As illustrated in FIG. 1, the retrieval device 10 is shown in a preferred installation making a connection with a mid-link 101*a* of the anchor chain 101. According to a preferred embodiment, the retrieval device 10 connects with the anchor chain 101 at a location near the leading end 102*a* of the anchor shank 102. The retrieval device 10 also connects with the anchor 100 at the leading shank end 102*a*, and is illustrated in the exemplary embodiment connecting with the shank eye hole 106 of the anchor 100.

According to a preferred embodiment, the device 10 connects with the anchor 100 and anchor chain 101, and the anchor chain 101 also makes another connection at another location on the anchor 100. The anchor chain 101 is shown connected to the crown eye hole 103 located at the crown end 107 of the anchor 100. Preferably, the anchor chain 101 may be fastened to the crown eye hole 103 at the terminal chain end 101*b*, though, according to alternate embodiments, it may be fastened to other locations on the anchor 100 that will facilitate a pulling force load from a direction other than the shank eye connection. A connector such as for example a shackle 22, may be used to make the connection between the chain end 101*b* and the crown eye hole 103. The connection points on the anchor 101 are shown as the shank eye hole 106 and crown eye hole 103, however, according to alternate embodiments, a suitable connecting point may be made by drilling a hole in the anchor (for example, where the anchor has no crown eye. The anchor chain 101 preferably is secured to the crown eye hole 103 of the anchor crown end 107 with a suitable fastening member, such as, for example, the bolt 104 and nut 105. Though the bolt 104 and nut 105 are shown fastening the terminal end 101*b* of the chain 101, other suitable fastening members may be used to secure the anchor chain 101 to the crown eye hole 103. The bolt 104 extends through the crown eye hole 103 and a link 101*b* of the anchor chain 101 (which preferably is a terminal link, as in this example) and is secured with the nut 105. The nut 105 and bolt 104 may be matingly threaded, and the nut 105 may be a lock nut. In the embodiment illustrated in FIGS. 1 and 2, preferably, the anchor chain 101 extends beyond its connection with the retrieval device 10 made at the shank end.

The retrieval device 10 permits the anchor 100 to be deployed (i.e., dropping anchor) and raised (i.e. weighing anchor) according to customary anchoring procedures, when the anchor 100 is not obstructed. For example, an anchor 100 to which the retrieval device 10 is installed may be dropped and set on the bottom of the water body. When set, the anchor 100 restricts or prevents movement of the vessel to which the other end of the anchor line 201 is secured. Once the anchor 100 is set, the vessel operator may permit it to remain set until it is time to weigh anchor (i.e., raise the anchor). Some anchors rely on weight and may not bury themselves (or a portion thereof) in order to be set, but, rather, are set by dropping onto the bottom of a water body. However, depending on their construction, these anchors too may be susceptible to being lodged in an obstruction. Notwithstanding the operator action, at times, a set anchor may detach from the bottom causing a marine craft to drag anchor. In some cases, the anchor may reset itself, possibly with the marine craft in a different location, or, in other cases, the anchor may need to be reset by an operator of the craft.

The retrieval device 10 is configured so that, if the anchor is not obstructed, the device 10 may remain installed on the anchor 100 and anchor chain 101 when the anchor 100 is hoisted from the bottom of the water body, and when the anchor 100 is raised and stowed aboard the vessel (such as for example on an anchor roller or hawse pipe).

There are some instances where the anchor 100 engages an obstruction (such as a structure on the water bottom, e.g., rocks, wreckage, or other debris or material), and the anchor 100 secures itself to the obstruction. In these situations, many times, attempts to raise the anchor 100 through conventional methods fail. The force load applied to raise an obstructed anchor 100 generally draws the vessel toward the location of the anchor 100 as the anchor rode 200 is taken up. The vessel operator may realize that the vessel anchor is lodged in an obstruction. Also, mechanical devices or electromechanical devices, such as, for example, a windlass, may cease applying additional pulling force on the anchor line once a maximum pull has been reached (such as when a retrieval force applied to the anchor line fails to dislodge a set anchor).

The retrieval device 10 is configured to disengage a connection between the anchor chain 101 and the anchor 100 that the retrieval device 10, prior to its actuation, had secured. According to preferred embodiments, the retrieval device 10 may be constructed so that one or more of its components may be retrieved along with the anchor 100 or anchor chain 101. According to a preferred embodiment, the retrieval device 10, upon disengagement of the anchor and chain connection (at the shank eye hole 106 and the mid-link 101*a*), remains attached to one or the other of the anchor 100 or anchor chain 101. According to some preferred embodiments, the retrieval device 10 may be configured so that, after the retrieval device 10 is actuated and the connection disengaged, at least one or more components of the retrieval device 10 remain on one or the other or both of the anchor 100 and anchor chain 101.

According to some preferred embodiments, one or more components of the device 10 may be provided with predefined shear points that are actuated by application of a predetermined force threshold, which generally matches the power and size of the vessel. The retrieval device 10 is actuated by applying a force load on the anchor 200 that is greater than the peak force threshold of the release mechanism of the retrieval device 10. The retrieval device 10 preferably has a predetermined peak force threshold, which, when a force load equal to (or exceeding) the peak load is applied to the retrieval device 10 by the anchor line 200, causes the disengagement or planned failure of at least one of the retrieval device connections whereupon the device 10 disengages at least one of its connections.

An exemplary embodiment of the retrieval device 10 is illustrated in FIGS. 1-5. The retrieval device 10 is constructed with a release mechanism that provides a releasable connection (such as a breakaway or disengagement) between the anchor line 200 (the anchor chain 101 illustrated in the figures) and a connection point on the anchor 100. The retrieval device 10 preferably is installed to provide one connection between the anchor 100 and the anchor chain 101, while the anchor chain 101 is fastened to the anchor 100 at a different location to make a second connection.

Figure 2:
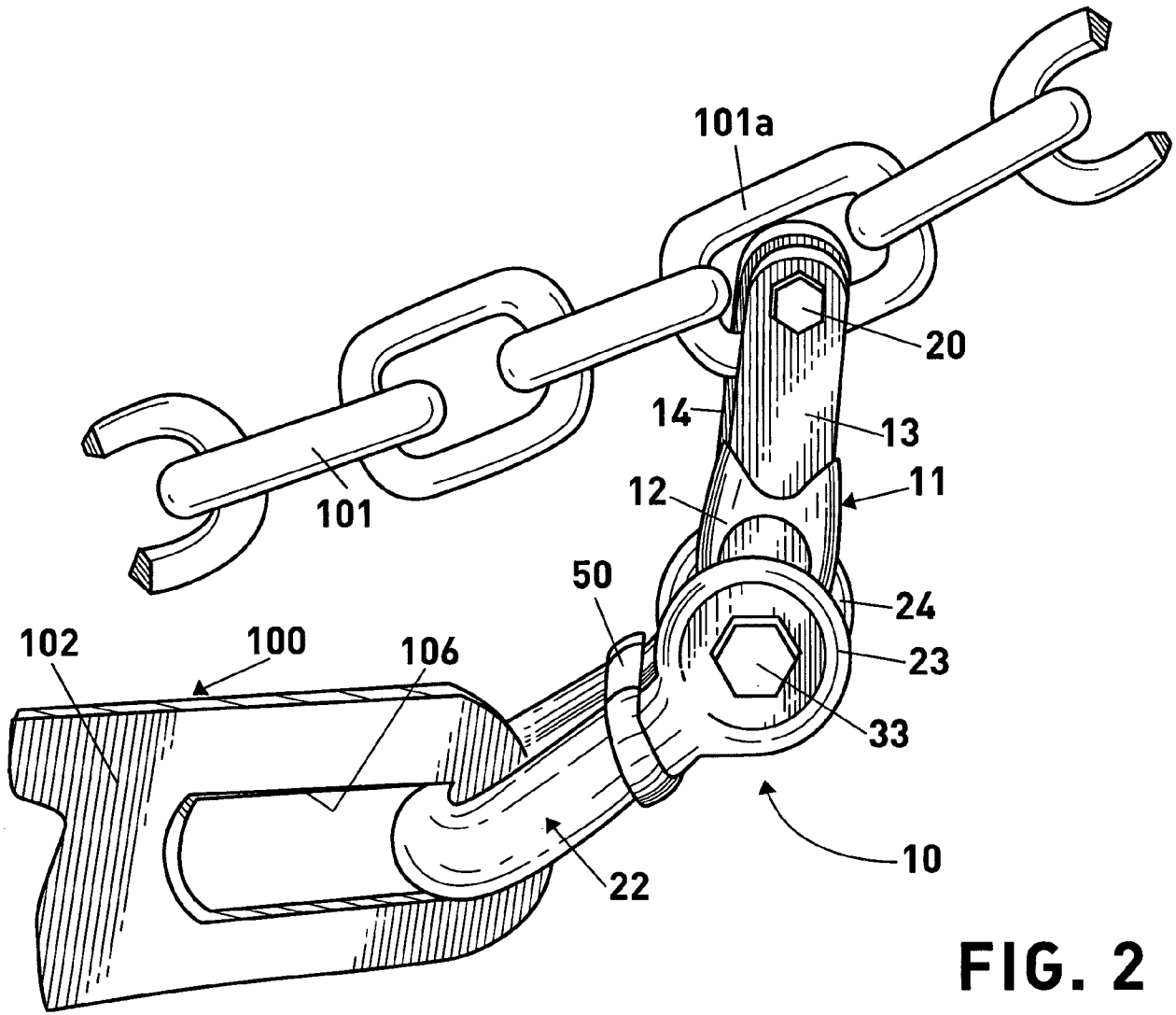
FIG. 2 is an enlarged side perspective view illustrating the retrieval device shown in FIG. 1 with the anchor chain and a portion of the anchor shank.
Figure 3:
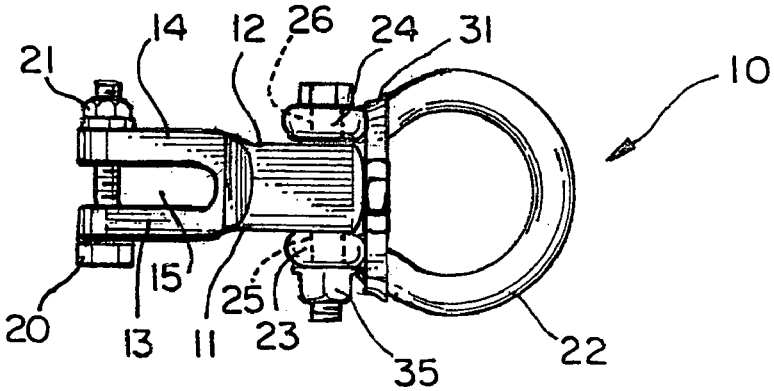
FIG. 3 is a top plan view of an exemplary embodiment of a retrieval device according to the invention shown in an assembled condition but without the anchor and anchor rode.
Figure 4:
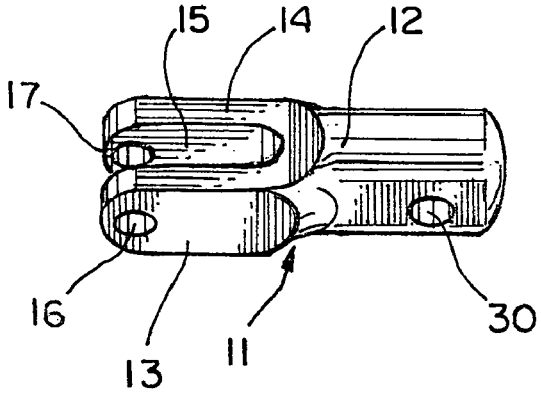
FIG. 4 is a perspective view of a release bar member of the retrieval device of FIG. 3, shown separately from the other components.

Referring to FIG. 3, an exemplary embodiment of the retrieval device 10 is illustrated in a preferred configuration, with the components shown in an assembled condition, but without the anchor 100 and anchor rode 200. The retrieval device 10 is useful for facilitating retrieval of a marine anchor from a water bottom. According to a preferred embodiment, the retrieval device 10 is constructed having a release bar member 11. The release bar member 11 is configured to make a first connection utilizing the shackle 22 which in turn is connected to the anchor shank eye 103 of the anchor 100 (as illustrated in FIGS. 1 and 2). The release bar member 11 is shown in an exemplary configuration having a body portion 12, a first leg 13 and a second leg 14. The first leg 13 and second leg 14 are spaced apart from each other to define a slot 15 therebetween. As illustrated in FIG. 4, the first leg 13 has a first leg bore 16 and the second leg 14 has a second leg bore 17. The first leg bore 16 and second leg bore 17 are shown disposed in an opposing relationship to accommodate a fastener. The retrieval device 10 has a connection capability to connect with the anchor 100 and anchor chain 101. A connector, shown comprising a fastener or bolt 20 facilitates the connection of the release bar member 11 with the anchor chain 101. A nut 21 is provided to secure the bolt 20 on the first leg 13 and second leg 14 (FIGS. 2 and 3). Preferably, the release bar member 11 is constructed of a material which is suitably strong so that the connection made between the release bar member 11 and the anchor chain 101 is stronger than the release pin 31 connection made to connect the shackle 22 with the release bar member 11. The first leg bore 16 and second leg bore 17 of the release bar member 11 preferably are provided a suitable distance from the end of the release bar member legs 13, 14 respectively, so that the bores 16, 17 maintain the connection with the chain 101 and the bolt 20. The retrieval device 10 further includes a connector, such as, for example, the shackle 22, for attaching the retrieval device 10 to the anchor 100. The shackle 22 is shown making a connection with the anchor shank eye 106, while other components of the device 10 connect with a mid-link 101*a* on the anchor chain 101 (FIGS. 1 and 2). The shackle 22 has a first arm 23 and a second arm 24. The shackle first arm 23 has a first shackle aperture 25 therethrough, and the shackle second arm 24 has a second shackle aperture 26 therethrough. The shackle 22 is configured to releasably connect the device 10 to the anchor 100 by making a releasable connection between the device 10 and the anchor 100. According to the embodiment illustrated in FIGS. 1-5, the shackle 22 is releasably connected to the release bar member 11. Preferably, the connector, such as an existing shackle of an anchor 100 that may be used for securing the end of the anchor chain 101 to the shank eye 106 of the existing anchor is relocated to the crown end 107 and is secured to the crown eye hole 103. The connector or shackle 222 is secured with the chain 101 to the crown eye hole 103 in a position where the shackle faces the shank eye 106, and retained on the crown end with a bolt, preferably constructed from stainless steel, and one or more spacers and a lock nut, also preferably constructed from stainless steel. According to a preferred installation, the connector, such as the shackle 222, at the crown end 107, is secured into a position so that it remains in that position.

As illustrated in FIG. 3, according to a preferred embodiment, the release bar member 11 may be provided with a through bore 30 disposed in the body portion 12. The shackle first arm 23 and shackle second arm 24 are shown spaced apart from each other and secured on opposite sides of the release bar member body portion 12. The first shackle aperture 25 and second shackle aperture 26 are aligned with the through bore 30 of the release bar member 11.

Figure 5:
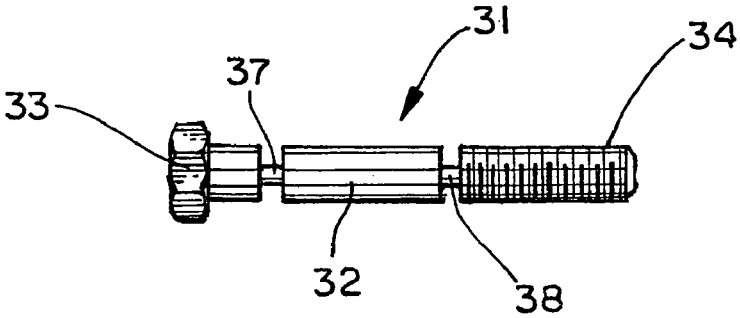
FIG. 5 is a top plan view of a release pin of the retrieval device of FIGS. 1-3, shown separately from the other components.

A release pin 31 is provided to connect the shackle 22 with the release bar member 11. The release pin 31 is configured for installation through the first shackle aperture 25, the release bar through bore 30 and the second shackle aperture 26. Referring to FIG. 5, the release pin 31 is shown in a preferred configuration having a shaft portion 32 which includes a break away construction that permits predicted failure of the release pin 31 when subjected to a force load of a predetermined peak force threshold. Preferably, the release pin 31 is constructed from materials that have suitable strength and corrosion resistance, and that are able to withstand a force load applied to retrieve an anchor and to withstand forces exerted on a set anchor when an anchor is not lodged in an underwater obstruction. According to preferred embodiments, the release pin 31 may be constructed from brass or other metal. The predetermined peak force threshold of the release pin 31 is based on the force load that a vessel that is secured by the anchor 100 may apply by pulling. According to preferred embodiments, the peak force threshold of the release mechanism is not met when an anchor 100 is not obstructed, as the force applied to release the set of an unobstructed anchor (e.g., release the anchor from the bottom) is considerably less than the force threshold required to actuate the retrieval device 10. The release pin 31 has a head 33 and a threaded portion with threads 34. The threads 34 are provided to connect with matingly corresponding threads of a fastening element, such as, for example, the lock nut 35. The lock nut 35 secures the release pin 31 to connect the shackle 22 to the release bar member 11, and thereby connect the shackle 22 to the anchor 100.

According to preferred embodiments, the release pin 31 is configured with a failure mechanism provided on the pin shaft 32, and is illustrated as the failure points shown as the annular grooves 37, 38 (FIG. 5). The release pin 31 is a shearale member where the annular grooves 37, 38 may serve as shear points when a predetermined peak load is applied to the device 10. The release pin 31 shear points preferably are configured to match the power and size of the vessel. According to a preferred configuration, the annular grooves 37, 38 are provided at locations along the pin shaft 32, so that when the pin 31 is installed on the device 10, each of the grooves 37, 38 aligns proximate to one of the shackle arms 23, 24. The release pin 31 construction, such as, for example, materials used, its diameter, the size and depth of the grooves 37, 38, or combinations of these properties, may be used to control the shearing force peak threshold load.

The release pin 31 and release bar member 11 preferably are constructed so that the release peak force load or threshold required to actuate release is matched to the power of the boat, as well as the anchor being used. The peak force load that is required to actuate the device 10 may be regulated by the construction of the materials used, as well as dimensions of the release pin 31 or other components. As illustrated in FIG. 3, the release pin 31 may be installed from either side to install the shackle 22 on the release bar member 11. FIGS. 1 and 2 show the release pin 31 installed from one direction whereas the release pin 31 in FIG. 3 is shown installed from the opposite direction. According to a preferred embodiment, the release bar 12, release pin 31 and shackle 22 are dimensioned so that the release pin 31 may be installed from either direction, and the grooves 37, 38 substantially align near the shackle ends 23, 24.

According to one embodiment, which, for example, may be used for boats up to about thirty-eight feet in length, a short link ¼ inch anchor chain is used, and a release pin 31 may be provided having a diameter of about 0.20 inches. In this example, the corresponding leg apertures of the release bar member 11 preferably have a diameter, for example, of about 0.213 inches, which is slightly larger than the diameter of the connector, the bolt 20. The diameter of the through bore 30 in the release bar member may be larger than the largest size pin diameter, where the device 10 is configured to use release pins of different sizes that may be installed for use on the same release bar member 11 in order to provide different release peak force thresholds, so that one may be chosen that matches the boat and its power characteristics. In this example, the release bar member 11 may be constructed from a material that preferably is strong and will not corrode, such as stainless steel. The release bar member 11 may be about 2.4 inches in length, according to one embodiment, with legs of about one inch, and a slot formed between the legs having a width to accommodate a diameter of the link of the chain that is to be secured. For example, according to an example where the device 10 is used with a ¼ inch anchor chain, the slot may be about 0.325 inches. According to another example, a larger size chain of about 5/16 inch or 7/16 inch, the slot width preferably is wide enough to accommodate the chain diameter, and the release pin hole diameter may be larger to accommodate a larger diameter release pin.

The retrieval device 10 preferably is connected to the anchor 100 by a making a connection with the anchor shank eye 106. Referring to FIG. 2, the shackle 22 passes through the anchor shank eye 106 and is secured to the release bar member 11 with the release pin 31 and nut 35. The anchor shank eye 106 is shown at the leading end 102*a* of the anchor shank 102. The retrieval device 10 connects with the anchor 100, as the shackle 22 passes through the anchor shank eye 106 to facilitate installation of the device 10 on the anchor 100. The shackle connection with the anchor 100 preferably is releasable to detach the connection of the anchor 100 with one or more portions or components of the device 10 (upon application of a predetermined force load), and thereby release the connection that the device 10 makes with the anchor 100 and anchor chain 101. The release of this connection, however, preferably is accomplished with the device 10 (or some of the device components) remaining on one or the other of the anchor line 101 or anchor 100. When an anchor is obstructed, the force that may usually be applied to release the set of the anchor under anchoring conditions where the anchor is not obstructed, is exceeded. Additional force, therefore, is applied in order to attempt to dislodge the anchor 100 from the obstruction. The force applied to the obstructed anchor increases, until it exceeds the peak force threshold of the retrieval device 10. According to a preferred embodiment, the retrieval device 10 release mechanism is actuated when the force threshold of the release pin 31 installed in the release bar member 11 has been exceeded. This force load causes one or more of the release pin 31 failure points to break, and the connection between the shackle 22 and the release bar member 11 disconnects. A force load applied to the release bar member 11 through the pull of a vessel exceeds the peak force load threshold that the pin 31 is able to withstand (for example, when an anchor 100 is obstructed), actuates the release feature of the device 10, causing the shackle 22 to disengage from the release bar member 11. According to preferred embodiments, the force required to break the release or shear pin 31 may necessitate the operator tying the rode 200 off to the port or starboard bow cleat while the boat is positioned directly over the anchor 100. Forward movement of the boat in the direction of the anchor set then creates sufficient pressure to break the shear pin 31.

According to preferred embodiments, the components of the device 10 (with the possible exception of the pin 31) may be retained on the anchor 100 or the anchor chain 101 even after actuation occurs and device 10 components, such as the release bar member 11 and shackle 22, have released their connection. A retaining mechanism may be provided to facilitate retention of one or more of the components when the release mechanism of the retrieval device 10 is actuated. According to the exemplary embodiment, as shown in FIGS. 1-3, a retaining means may include a retainer 50 installed on the shackle 22. The retainer 50 may comprise a stainless steel wire tie, a stainless steel wire, an elastic member such as an o-ring, or other suitable member, and may be made from suitable materials, including, for example, synthetic rubber, stainless steel, plastic or the like. The retainer 50 is shown installed on the first arm 23 and second arm 24 of the shackle 22. The configuration of the shackle 22 and the placement of the retainer 50 facilitates maintenance of the shackle 22 on the anchor shank eye 106, even after the release pin 31 has released the shackle connection with the release bar member 11 (e.g., such as under conditions of a peak force load exceeding the predetermined force threshold of the release mechanism). For example, where the retainer 50 comprises an o-ring, the retainer 50 preferably is installed prior to connecting the shackle 22 to the release bar member 11 (or before another connection is made that may prevent the retainer 50 from being installed).

Referring to FIG. 1, according to a preferred installation configuration, the anchor chain 101 is shown having connections with the anchor 100 at the crown end 107 and at shank end 102 to handle the force load of a retrieval force applied to the anchor 100. The retrieval device 10 and the installation configuration illustrated enables a force load applied to retrieve the anchor 100 from a water bottom, for example, by the hoisting of the anchor line 200 (and anchor chain 101 connected thereto). Under conditions where the anchor 100 is not obstructed, the anchor set may be released and the anchor chain connections with the anchor and device 10, preferably, remain connected. This enables retrieval of the anchor 100 with the shank end 102 as the leading end 102*b*. However, when the force applied to retrieve an anchor 100 is insufficient due to the anchor 100 being obstructed, the release mechanism of the device 10 will actuate when additional force (the peak load) is applied and reaches the predetermined release force threshold of the device 10. According to the embodiment illustrated, the release of the connection of the anchor chain 101 at the anchor shank eye 106 occurs upon the shearing of the release pin 31.

The use of the anchor release and retrieval system and method may be carried out by repositioning an existing anchor chain, such as the chain 101, to connect at the crown 106 of an existing anchor 100. The repositioning provides a different point of retrieval on the anchor. Another location along the chain 101 is connected by the device to the anchor shank 102, preferably at the shank eye 106. The device 10 releasably connects an anchor 100 with an anchor rode 200 to provide an alternate point of retrieval relative to a location along the anchor 100 for facilitating retrieval of the anchor 100. A preferred embodiment of the device 100 includes a component, such as, for example, a releas bar member 12 having a first attachment means for making a first connection with an anchor and a second attachment means for making a second connection with an anchor rode 200 connected to the anchor 100. At least one of the first attachments means and said second attachment means comprises a fastener means, such as a releasable fastening means, with a release mechanism, shown, for example, as the shearable release pin 31 shown in the preferred embodiment, for making a releasable connection and releasing that releasable connection upon being subjected to an application of a force load of at least a predetermined peak force threshold. The other one of the first attachment means and the second attachment means retains its connection upon being subjected to the application of that force load.

Figure 6:
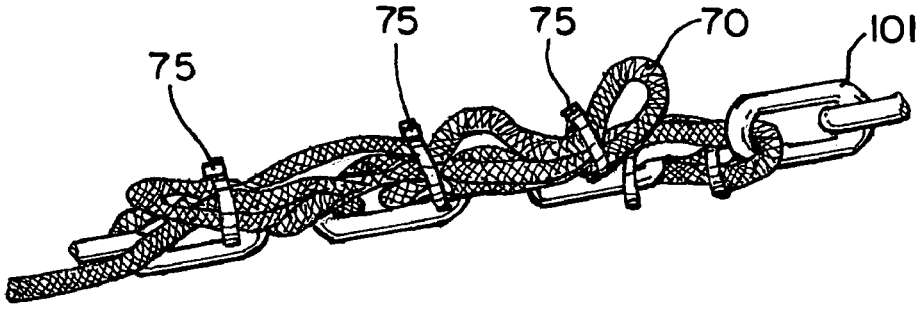
FIG. 6 is a side elevation view illustrating the retrieval device and the reset line in an environment with an anchor rode.

According to a preferred embodiment, one end of the release bar member 11 connects to the anchor shank eye 106 via the shackle 22 and the release pin 31. The other end of the release bar member 11 is attached to a mid-link 101*b* on the anchor chain 101 with a fastener, such as, for example, the stainless steel bolt 20 and lock nut 21. Referring to FIG. 6, preferably, a reset line 70 may be connected to the anchor chain 101 and the anchor shank eye 106. An optional feature of the present device, system and method includes a reset line 70. The reset line 70 may be used to facilitate retrieval of the anchor onto the vessel. After release, the anchor 100 is presented to the bow pulpit in an upside down position. Upon retrieval, and, once the end of the reset line 70 (attached to a mid link) may be reached, as the chain 101 is retrieved, the reset line 70 is pulled and the reset line 70 flips the anchor 100 to the proper shank up position, from which the anchor 100 may easily be lifted through the bow pulpit and secured (instead of lifting the heavy anchor over the bow). According to a preferred embodiment, the reset line 70 has a suitable length to facilitate righting the anchor 100. According to a preferred embodiment, the reset line 70 may have a length approximately four times the length of the anchor shank 102, though other suitable lengths may be used. Preferably, the reset line 70 is connected between the anchor shank eye 106 and the anchor chain 101, and is bundled and stored on the anchor rode 200. The reset line 70 may be installed by tying one end of the reset line 70 to the anchor shank eye 106 and tying another end of the reset line 70 to the anchor chain 101 preferably at a location on the anchor chain 101 upstream of the anchor shank end 102*a*.

Figure 7:
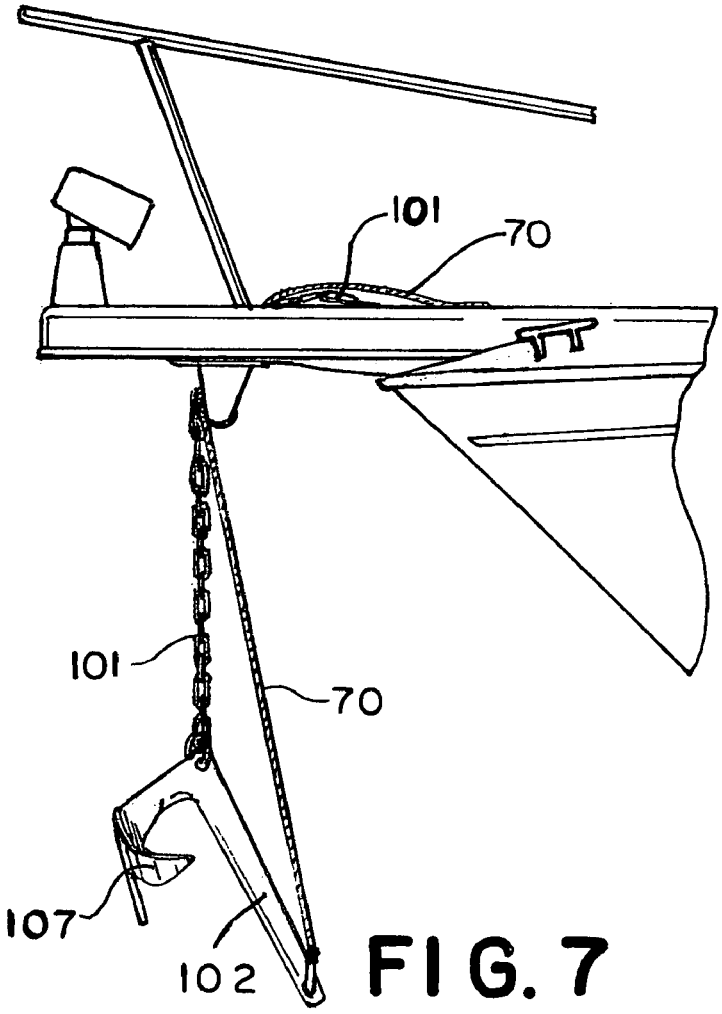
FIG. 7 is a side elevation view illustrating the retrieval device and the reset line in a recovery position.

The reset line 70 preferably is connected to the anchor shank eye 106 (the point of connection that is released by the device 10 according to the embodiment illustrated when the components of the device 10 are actuated). Since, when the anchor 100 is retrieved from the anchor crown end 107, from the anchor chain connection at the anchor crown eye 103, generally, as illustrated in FIG. 7, the anchor shank end 102*a* will follow the crown end 107 (i.e., retrieve the anchor upside down). This means that an operator must manually lift the anchor 100 in order to right the anchor position to bring the anchor aboard. In some cases, the anchor may be of substantial weight and may be located below the boat edge. The reset line 70 may be retrieved along with the anchor chain 101 and, upon retrieval, may be expanded from its bundled or stored position on the anchor chain 101 as the anchor chain 101 approaches or is brought aboard the vessel. Unraveling the bundled portion of the reset line 70 releases the slack of the reset line 70 (though the line retains its connection with the shank eye hole 106 and, preferably, also with the anchor chain 101). The reset line 70 may then be hoisted to right the anchor 100 and hoist the anchor 100 to a stowed position. This may be done by manually hoisting the reset line 70 or by attaching the reset line 70 to a mechanical or electromechanical device, such as, for example, a windlass, or other suitable device. Once the anchor 100 is stowed, the reset line 70 may be reset to be replaced to its set condition (with the excess slack tied to the anchor chain 101). FIG. 6 shows an example of a reset line 70 installed in a stored condition. Securing elements, such as, for example, the plastic electrical ties 75, may be used to fasten the line 70 to the anchor chain 101.

When the retrieval device 10 is installed with an anchor 100 and anchor rode 200, the force used to retrieve an unobstructed anchor preferably remains on the terminal end 101*b* of the anchor chain 101 (which, in the example illustrated in FIGS. 1 and 2, is attached to the crown end 107). According to this preferred installation configuration with selection of a suitable mid-link on the chain, limited pressure is placed on the anchor release and retrieval device 10 (attached to the shank eye 106). When an anchor is not lodged in an underwater obstruction, the system, method and device 10 facilitate retrieval of an anchor utilizing conventional anchoring procedures. Should the marine anchor 100 become lodged in an underwater obstruction, a retrieval process is initiated that allows direct force to be applied to the release mechanism of the device 10, such as the release pin 31, causing the release pin 31 to shear thus enabling the anchor 100 to be pulled in a different direction, which may be backwards, in a direction opposite the direction the anchor 100 was set. The anchor 100 is then maneuvered out of the obstruction, for example, by backing the anchor 100 out of the obstruction, and the anchor 100 may then be retrieved by taking in the rode and the up righted with the use of the reset line 70. Once the anchor 100 is on board the vessel, according to the preferred embodiment, the release pin 31 may be replaced and reset line 70 are reset, and the anchor 100 is ready again for use.

Figure 8:
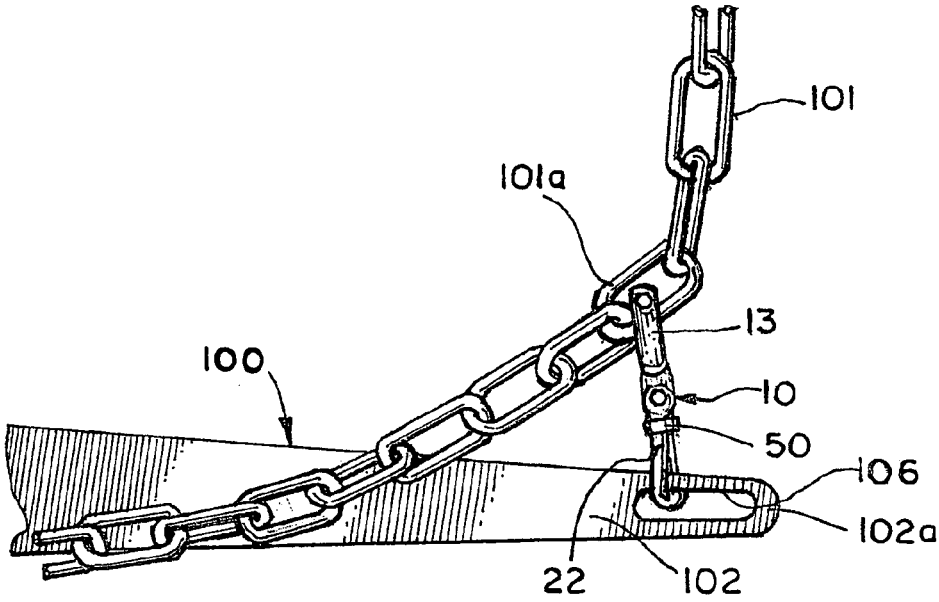
FIG. 8 is a side elevation view of the shank portion of an anchor shown with the retrieval device installed.
Figure 9:
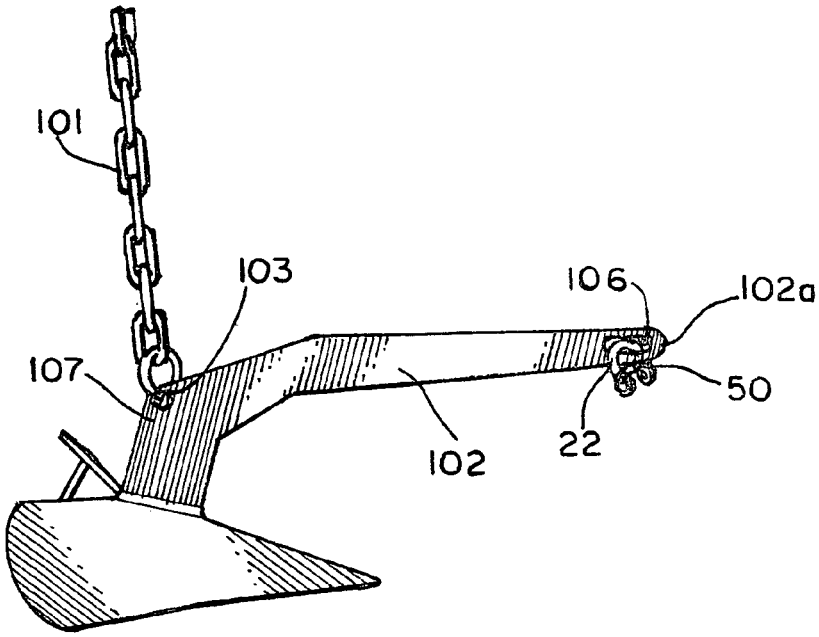
FIG. 9 is a side elevation view of an anchor shown with the anchor chain connected to the crown end in a preferred retrieval position.

Should a marine anchor become lodged in an underwater obstruction, a preferred method for facilitating the steps of the retrieval process may be as follows. According to a preferred retrieval method utilizing the device 10 and system, in order to retrieve an anchor 100 that has become lodged (e.g., in an obstruction), preferably, the boat is moved forward to a position as directly as possible over the anchor 100, as the slack in the anchor rode 200 is taken in. Once the boat is positioned directly over the anchor 100, the anchor rode 200 is tied off to a bow cleat of the boat. The boat is then moved slowly forward and slightly to the right or left of the path established while at anchor. This motion puts pressure on the anchor rode 200 and, in turn, the anchor release and retrieval device 10. The vertical pull shifts the retrieval pressure from the anchor shank 102 to the device 10 (see FIG. 8) which, when sufficient engine power is applied in the direction of the anchor set, will cause the shear pin 31 to break and release, thus enabling the anchor 100 to be backed out of the obstruction as the boat is moved slowly forward to port or starboard of the anchor set. The anchor 100 may then be retrieved. Preferably, the anchor 100 is then retrieved from the connection made at the crown end 107 (see FIG. 9). When the released anchor 100 is retrieved it will be positioned upside down (see FIG. 7) and will need to be righted so the shank 103 may be guided properly over or through the bow pulpit of a boat. Once the rode has been retrieved to the point that the reset line by pulling on the reset line 70 at this point in the retrieval procedure, the anchor 100 will be properly positioned and will be guided properly through or over the boat pulpit. The retrieval device 10 preferably may be configured so that it may be reset once it has actuated and been retrieved.

The marine anchor release and retrieval system, method and device 10 may be utilized as part of standard anchoring and anchor retrieval operations consistent with routine boating activities. This device 10 is configured so that, preferably, only when an anchor becomes lodged and the retrieval steps are initiated will the release mechanism be activated to relieve the lodged anchor, otherwise the marine anchor release and retrieval system is designed to be a mostly unnoticed part of the normal anchoring system. The system and device may be constructed to utilize commercially available marine shackles which may be varied in size to provide installation flexibility in an economical manner. The device 10 may be constructed to be relatively compact and easily accommodated with a boat's existing anchoring system.

The device 10 is illustrated making a connection where the shackle 22 connects with the anchor shank eye 106 and the retaining bar member first leg 13 and second leg 14 connect with the anchor chain 101. However, according to an alternate configuration, the shackle 22 may connect with the chain 101 and the retaining bar member 11 may connect with the anchor shank eye 106. The release mechanism may be provided to release the connection with the anchor chain 101, such as providing a release pin 31 serving as a fastener at the point of connection made between the device 10 and the anchor chain 101.

The retrieval device 10 also is adaptable. According to a preferred embodiment, the release pin 31 of the retrieval device 10 may be readily removed, bypassed or replaced with a stronger component, such as a heavy steel bolt, in the event permanent mooring is desired, such as, for example, in extreme storm and wind conditions.

Though not shown, one or more washers may be provided to facilitate the connections of the bolt 104 onto the release bar 11, or the release pin onto the shackle 22. The shackle 22 preferably is installed in a locked position facing the anchor shank eye. Although fastening members are is illustrated as a bolt 104 with a locknut 105, other suitable mechanisms to attach the device 10 to the chain 101 may be employed.

Preferably the anchor retrieval device 10 is constructed using a brass release pin 31. Alternatively, the retrieval device 10 and release pin 31 may be constructed from suitable corrosion resistant materials including, for example, stainless steel, bronze, metal, as well as plastics. Various shapes and sizes of the release bar 31 and other components may be utilized to accommodate connection to the anchor rode midlink and anchor shank eye 106. For example, according to an alternate embodiment, a chain "Quick Link" with a "Release Spacer" may be used as an alternative to the release bar member 11.

While the invention has been described with reference to specific embodiments, the description is illustrative and is not to be construed as limiting the scope of the invention. Release pins of different force thresholds may be provided for use with vessels that are different sizes, weights or have different power drives, and may also take into account the weights of different anchors. The size and strength of the components of the retrieval device 10 may be varied to match the size and power of the vessel (such as a boat), as well as the anchor that is used for the vessel and the anchor chain used with the anchor. One or more release pins having different force thresholds may be provided with the device or system, and one of them may be selected for use with a force threshold to match the vessel, its power, the anchor and anchor chain, as well as boating conditions. For example, the device may be supplied as a kit that includes one or more release pins that may be selected for use with other components of the device. The device, system and method may be used in conjunction with the existing anchors and anchor lines customarily used by vessels. The components of the device 10 may be constructed from a suitable material, including stainless steel. Preferably, the materials used are resistant to water, salt and corrosion that may otherwise affect the operation of the device 10. Stainless steel, brass, metals, metal alloys and other suitable materials may be used to construct the device 10. Since, in many instances, the anchor characteristics are selected based on the vessel that the anchor is being used to secure, the release pin may be configured to have its peak force threshold correspond with or have some relationship to the weight of an anchor being used. In addition, the device may be constructed of different sizes and dimensions, as well as the pin structure to further facilitate matching the device break away force threshold to the force of the vessel that provides the pulling power to actuate the release of the device 10 to disconnect the anchor and chain connection made with the device 10.

Though the device, method and system are described in connection with an anchor having a crown eye, other anchors not having a crown eye may be used. A connection at the crown end may be made with a suitable connecting mechanism. For example, a hole may be drilled in the anchor (e.g., at the crown area) so that the crown area or a second connection with the anchor line 101 may be made (e.g., by passing a bolt through to secure the chain).

Various modifications and changes may occur to those skilled in the art without departing from the spirit and scope of the invention described herein and as defined by the appended claims.

The invention claimed is:

1. A device for facilitating retrieval of a marine anchor that releasably connects an anchor with an anchor rode to provide an alternative point of retrieval relative to a location along the anchor for facilitating retrieval of the anchor, the device comprising:

a) a component having a first attachment means for making a first connection with an anchor and having second attachment means for making a second connection with an anchor rode connected to the anchor;

b) wherein at least one of said first attachment means and said second attachment means comprises a releasable fastening means for making a releasable connection and releasing that releasable connection upon being subjected to an application of a force load of at least a predetermined peak force threshold, and wherein at least the other one of said first attachment means and said second attachment means retain its respective first connection with the anchor or second connection with the anchor rode upon being subjected to said force load;

wherein said releasable fastening means comprises a release mechanism; and wherein the release mechanism comprises a shearable member;

wherein said shearable member will shear allowing the releasable fastening means to release its connection when the component is operated under a force load that exceeds a predetermined peak force threshold.

2. The device of claim 1, wherein the shearable member comprises a fastener.

3. The device of claim 1, wherein the shearable member comprises a release pin.

4. The device of claim 3, wherein the release pin has a threaded portion, and wherein a matingly threaded nut is provided to secure said component on an anchor structure.

5. The device of claim 1, wherein the one of said first attachment means and said second attachment means that retains its connection upon being subjected to said application of said force load comprises a fastener.

6. A device for releasably connecting an anchor with an anchor rode to provide an alternate point of retrieval at a location along the anchor for facilitating retrieval of an anchor comprising:

a) a release bar having a body portion, a first leg and a second leg, the first leg and second leg being spaced apart from each other and being oppositely disposed to define a slot therebetween;

b) a bore disposed in the body portion of the release bar and extending through the body portion;

c) an aperture disposed in each of said first leg and said second leg, said apertures being oppositely situated in relation to each other;

d) a shackle having first arm and a second arm with apertures disposed in each arm;

e) a release pin having shear points, the release pin disposed through said shackle first arm aperture, said release bar through bore, and said shackle second arm aperture to releasably secure the shackle to said release bar;

f) a nut provided to secure the release pin to the shackle and release bar; and g) a fastener for installation through the apertures of said first leg and said second leg of the release bar for connecting the release bar to an anchor rode;

h) wherein the shear points of the release pin comprise annular grooves provided in the release pin, and wherein the annular grooves are provided so that when the release pin is installed, the annular grooves are respectively located proximate to the shackle first arm and second arm.

7. The device of claim 6, further comprising a reset line.

8. The device of claim 6, further comprising retaining means for retaining the shackle so it may be retrieved with the anchor.

9. A method of retrieving a marine anchor used to anchor a marine craft comprising:

a) providing an anchor having a crown end and a shank end having a shank eye;

b) providing an anchor rode having at least one terminal end;

c) connecting said anchor rode terminal end to the crown end of the anchor;

d) providing a release bar;

e) connecting the release bar to the shank end of an anchor;

f) connecting the release bar to a location along the anchor rode;

g) wherein connecting the release bar to the shank eye of the anchor includes providing a release mechanism comprising a release pin and a nut and using the release pin and nut to make a connection between the release bar and the shank eye of the anchor;

h) lowering the anchor with the release bar connected thereto;

i) retrieving the anchor from an obstruction by:

i) securing the anchor rode to the marine craft;

ii) moving the marine craft in a direction to provide a pulling force on the anchor;

iii) releasing said connection between the release bar and the shank of the anchor by actuating said disengagement mechanism with said pulling force by applying a force load that exceeds the peak force threshold of the release pin to break the release pin;

iv) hoisting the anchor by applying a pulling force to retrieve the anchor from the anchor crown end.

10. An anchor having a releasable feature that includes the device of claim 6.

11. A kit providing an anchor and an apparatus for facilitating the retrieval of the anchor, the kit comprising:

a) an anchor;

b) the apparatus comprising the device of claim 1.

12. The kit of claim 11, wherein said kit further comprises a plurality of shearable members having different force shearing thresholds, and wherein said releasable fastening means comprises a shearable member is selected from said plurality of shearable members.

13. A device for facilitating retrieval of a marine anchor that releasably connects an anchor with an anchor rode to provide an alternate point of retrieval relative to a location along the anchor for facilitating retrieval of the anchor, the device comprising:

a) a component having a first attachment means for making a second connection with an anchor and having second attachment means for making a second connection with an anchor rode connected to the anchor;

b) wherein at least one of said first attachment means and said second attachment means comprises a releasable fastening means for making a releasable connection and releasing that releasable connection upon being subjected to an application of a force load of at least a predetermined peak force threshold, and wherein at least the other one of said first attachment means and said second attachment means retains its respective first connection with the anchor or second connection with the anchor rode upon being subjected to said application of said force load;

wherein said releasable fastening means comprises a release mechanism; and wherein the release mechanism comprises a release pin configured to break when subjected to said application of a force load of at least a predetermined peak force threshold.

14. A device for facilitating retrieval of a marine anchor that releasably connects an anchor with an anchor rode to provide an alternate point of retrieval relative to a location along the anchor for facilitating of the anchor, the device comprising:

a) a component having a first attachment means for making a first connection with an anchor and having second attachment means for making a second connection with an anchor rode connected to the anchor;

b) wherein at least one of said first attachment means and said second attachment means comprises a releasable fastening means for making a releasable connection and releasing that releasable connection upon being subjected to an application of a force load of at least a predetermined peak force threshold, and wherein at least the other one of said first attachment means and said second attachment means retains its respective first connection with the anchor or second connection with the anchor rode upon being subjected to said application of said force load;

wherein said releasable fastening means comprises a release mechanism; and wherein the release mechanism comprises a shearable member; and wherein said component comprises a release bar member, wherein said shearable member engages said release bar member to form said releasable connection, and wherein said release bar member has a portion thereof that prevents disengagement of the release bar member until said shearable member is broken.

15. A device for facilitating retrieval of a marine anchor that releasably connects an anchor with an anchor rode to provide an alternate point of retrieval relative to a location along the anchor for facilitating retrieval of the anchor, the device comprising:

a) a component having a first attachment means for making a first connection with an anchor and having second attachment means for making a second connection with an anchor rode connected to the anchor;

b) wherein at least one of said first attachment means and said second attachment means comprises a releasable fastening means for making a releasable connection and releasing that releasable connection upon being subjected to an application of a force load of at least a predetermined peak force threshold, and wherein at least the other one of said first attachment means and said second attachment means retain its respective first connection with the anchor or second connection with the anchor rode upon being subjected to said application of said force load;

wherein said releasable fastening means comprises a release mechanism; and wherein the release mechanism comprises a shearable member that holds said component fastened with said releasable fastening means until a force is applied to break said shearable member.

* * * * *